US011255172B2

(12) United States Patent
Batarseh et al.

(10) Patent No.: US 11,255,172 B2
(45) Date of Patent: Feb. 22, 2022

(54) HYBRID PHOTONIC-PULSED FRACTURING TOOL AND RELATED METHODS

(71) Applicant: Saudi Arabian Oil Company, Dhahran (SA)

(72) Inventors: Sameeh Issa Batarseh, Dhahran (SA); Wisam Jamal Assiri, Dhahran (SA); Abdullah M. Al-Harith, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 175 days.

(21) Appl. No.: 16/439,405

(22) Filed: Jun. 12, 2019

(65) Prior Publication Data

US 2020/0392824 A1 Dec. 17, 2020

(51) Int. Cl.

| | |
|---|---|
| ***E21B 43/24*** | (2006.01) |
| ***E21B 37/00*** | (2006.01) |
| ***E21B 27/02*** | (2006.01) |
| ***E21B 43/263*** | (2006.01) |
| ***E21B 29/02*** | (2006.01) |

(52) U.S. Cl.

CPC ..... *E21B 43/2405* (2013.01); *E21B 27/02* (2013.01); *E21B 29/02* (2013.01); *E21B 37/00* (2013.01); *E21B 43/263* (2013.01)

(58) Field of Classification Search

CPC .... E21B 43/26; E21B 43/263; E21B 43/2405; E21B 29/02; E21B 27/02; E21B 37/00

See application file for complete search history.

(56) References Cited

U.S. PATENT DOCUMENTS

| | | | | |
|---|---|---|---|---|
| 2,436,036 | A | 2/1948 | Defenbaugh | |
| 4,895,206 | A | 1/1990 | Price | |
| 6,543,538 | B2 | 4/2003 | Tolman et al. | |
| 6,888,097 | B2 | 5/2005 | Batarseh | |
| 7,503,404 | B2 | 3/2009 | McDaniel et al. | |
| 7,854,267 | B2 | 12/2010 | Smith et al. | |
| 8,678,087 | B2 | 3/2014 | Schultz et al. | |
| 8,967,293 | B2 | 3/2015 | Von Rohr et al. | |
| 9,488,042 | B2 | 11/2016 | Al-Nakhli et al. | |
| 10,047,277 | B2 | 8/2018 | Al-Dahlan et al. | |
| 11,028,647 | B2 * | 6/2021 | Batarseh | E21B 43/26 |
| 2008/0093125 | A1 | 4/2008 | Potter et al. | |
| 2009/0126235 | A1 | 5/2009 | Kobayashi et al. | |
| 2014/0305877 | A1 | 10/2014 | Cioanta et al. | |
| 2015/0300113 | A1 * | 10/2015 | Guttormsen | E21B 4/18 166/65.1 |

(Continued)

FOREIGN PATENT DOCUMENTS

| | | |
|---|---|---|
| EP | 3 227 518 A1 | 10/2017 |
| WO | WO-2006/117935 A1 | 11/2006 |

(Continued)

OTHER PUBLICATIONS

International Search Report for PCT/IB19/56779, 5 pages (dated Mar. 9, 2020).

(Continued)

*Primary Examiner* — D. Andrews

(74) *Attorney, Agent, or Firm* — Choate, Hall & Stewart LLP; Charles E. Lyon; Peter A. Flynn

(57) ABSTRACT

This application relates to systems and methods for stimulating hydrocarbon bearing formations using a hybrid downhole tool that uses a high power laser and chemicals.

22 Claims, 15 Drawing Sheets

(56) References Cited

U.S. PATENT DOCUMENTS

| | | | | |
|---|---|---|---|---|
| 2015/0300142 | A1 | 10/2015 | Al-Nakhli et al. | |
| 2015/0300143 | A1 | 10/2015 | Al-Nakhli et al. | |
| 2015/0330198 | A1 | 11/2015 | Al-Mulhem et al. | |
| 2015/0369229 | A1 | 12/2015 | Xiao et al. | |
| 2016/0069857 | A1 | 3/2016 | Batarseh et al. | |
| 2016/0160618 | A1* | 6/2016 | Batarseh | E21B 7/14 175/16 |
| 2016/0376884 | A1 | 12/2016 | Al-Nakhli et al. | |
| 2017/0101577 | A1 | 4/2017 | Al-Dahlan et al. | |
| 2017/0130570 | A1 | 5/2017 | Al-Nakhli et al. | |
| 2018/0163524 | A1 | 6/2018 | Batarseh | |
| 2018/0270920 | A1 | 9/2018 | Batarseh | |

FOREIGN PATENT DOCUMENTS

| | | | |
|---|---|---|---|
| WO | WO-2016/090229 | A1 | 6/2016 |
| WO | WO-2017/163265 | A1 | 9/2017 |
| WO | WO-2020/250025 | A1 | 12/2020 |

OTHER PUBLICATIONS

Written Opinion for PCT/IB19/56779, 8 pages (dated Mar. 9, 2020).
International Preliminary Report on Patentability for PCT/IB2019/056779, 15 pages (dated May 17, 2021).

* cited by examiner

HYBRID PHOTONIC-PULSED FRACTURING TOOL AND RELATED METHODS

TECHNICAL FIELD

This application relates to hybrid tools and related systems and methods for stimulating hydrocarbon bearing formations using high-power lasers and chemicals.

BACKGROUND

Wellbore stimulation is a branch of petroleum engineering focused on ways to enhance the flow of hydrocarbons from a formation to the wellbore for production. To produce hydrocarbons from the targeted formation, the hydrocarbons in the formation need to flow from the formation to the wellbore in order to be produced and flow to the surface. The flow from the formation to the wellbore is carried out by the means of formation permeability. When formation permeability is low, stimulation is applied to enhance the flow. Stimulation can be applied around the wellbore and into the formation to build a network in the formation. The first step for stimulation is commonly perforating the casing and cementing in order to reach the formation. One way to perforate the casing is the use of a shaped charge. Shaped charges are lowered into the wellbore to the target release zone. The release of the shaped charge creates short tunnels that penetrate the steel casing, the cement and into the formation.

The use of shaped charges has several disadvantages. For example, shaped charges produce a compact zone around the tunnel, which reduces permeability and therefore production. The high velocity impact of a shaped charge crushes the rock formation and produces very fine particles that plug the pore throat of the formation reducing flow and production. There is the potential for melt to form in the tunnel. There is no control over the geometry and direction of the tunnels created by the shaped charges. There are limits on the penetration depth and diameter of the tunnels. There is a risk in involved while handling the explosives at the surface.

The second stage of stimulation typically involves pumping fluids through the tunnels created by the shaped charges. The fluids are pumped at rates exceeding the formation breaking pressure causing the formation and rocks to break and fracture, this is called hydraulic fracturing. Hydraulic fracturing is carried out mostly using water based fluids called hydraulic fracture fluid. The hydraulic fracture fluids can be damaging to the formation, specifically shale rocks. Hydraulic fracturing produces fractures in the formation, creating a network between the formation and the wellbore.

Hydraulic fracturing also has several disadvantages. First, as noted above, hydraulic fracturing can be damaging to the formation. Additionally, there is no control over the direction of the fracture. Fractures have been known to close back up. There are risks on the surface due to the high pressure of the water in the piping. There are also environmental concerns regarding the components added to hydraulic fracturing fluids and the need for the millions of gallons of water required for hydraulic fracturing.

High power laser systems can also be used in a downhole application for stimulating the formation via, for example, laser drilling a clean, controlled hole. Laser drilling typically saves time, because laser drilling does not require pipe connections like conventional drilling, and is a more environmentally friendly technology with far fewer emissions, as the laser is electrically powered. However, there are still limitations regarding the placement and maneuverability of a laser tool for effective downhole use.

SUMMARY

Generally, this disclosure relates to the subsurface application of hybrid tools to establish communication between a wellbore and a hydrocarbon bearing formation for production of hydrocarbon fluids. The disclosed tools combine high power lasers with fracturing technology that uses pulsed energy generated by chemical reactions. The high power laser can be used to drill into the subsurface in any direction and orientation regardless of stress magnitude. The tool includes one or more compartments that are used to store and deliver chemicals, which will react to generate high pressure and temperature that causes fracturing networks to form. This technology provides for waterless fractures that are unique and will maximize production. This technology can be used with conventional and unconventional reservoirs. This disclosure is also directed to different systems and methods for using the hybrid tool in different configurations and for different applications to unlock reservoirs and increase stimulated reservoir volume to increase production.

The disclosed methods can drill and fracture the formation with one tool that includes two technologies combined to unlock potential reservoirs by, for example, controlling the fracturing depth and location, which enables several new recovery methods. The technologies include the combination of lasers and chemicals to perform multistage fracturing, where other technologies require different tools to perform a single operation, for example, one laser tool to perforate or drill, and another tool to fracture the formation using chemicals.

Generally, the disclosed downhole hybrid tool is superior to known technologies as it eliminates the need for hydraulic fracturing, limiting the need for scarce sources of fresh water; enhancing production in tight reservoirs by improving fracturing networks; and is able to by-pass non-paying zones within the formation by controlling tool orientation and fracturing depths.

In one aspect, the application relates to a hybrid tool for stimulating a hydrocarbon-bearing formation. The tool includes an elongate tool body having one or more chemical compartments and a laser head coupled to a distal end of the tool body and configured to operate within a wellbore of the formation.

The chemical compartment includes storage means for storing at least one chemical for reaction and delivery to the wellbore and delivery means for delivering a product of the chemical reaction to the wellbore. The laser head includes one or more optical transmission media, the one or more optical transmission media being part of an optical path originating at a laser generating unit configured to generate a raw laser beam, the one or more optical transmission media configured for passing the raw laser beam and an optical assembly coupled to the optical transmission media and configured to shape a laser beam for output.

In various embodiments of the foregoing aspect, the chemical compartment also includes a mixing compartment disposed therein and configured for receiving the chemicals stored within the chemical compartment. The storage means of the chemical compartment may include two receptacles configured for storing two or more chemicals for mixing, a piston configured for advancing within the two receptacles to eject the chemicals from the two receptacles to the mixing compartment, and a one-way valve disposed on a distal end of each of the two receptacles configured for passing the chemicals to the mixing compartment.

In some embodiments, the delivery means include one or more relief valves disposed in a wall of the chemical compartment, which itself may include a rotational assembly to orient the chemical compartment and delivery means towards a desired target. The chemical compartment may also include heating means for triggering a reaction of the one or more chemicals stored therein.

In various embodiments, the laser head includes a housing that contains at least a portion of the optical assembly and is configured for movement within the wellbore to direct the laser beam relative to the wellbore. The laser head may also include a plurality of orientation nozzles disposed about an outer circumference of the laser head, the plurality of nozzles configured to provide thrust to the laser head to control motion and orientation of the tool within the wellbore. In some embodiments, the plurality of orientation nozzles are movably coupled to the laser head to allow the orientation nozzles to rotate or pivot relative to the laser head to provide forward motion, reverse motion, rotational motion, or combinations thereof to at least the laser head.

The laser head may also include a purging assembly disposed at least partially within or adjacent to the laser head and configured for delivering a purging fluid to an area proximate the output laser beam. In some embodiments, at least a portion of the purge nozzles are vacuum nozzles connected to a vacuum source and configured to remove debris and gaseous fluids from the area proximate the output laser beam. The tool may also include at least one centralizer coupled to the tool and configured to hold the tool in place relative to an outer casing in the wellbore.

In still other embodiments, the tool includes an articulated arm disposed between the laser head and the laser generating unit. The articulated arm may include a snake robot having locomotion means for maneuvering the tool within the wellbore. The locomotion means may include at least one of an electrical motor or a hydraulic actuator. The tool may include a control system configured to control at least one of a movement or an operation of the tool.

Additionally, the tool may include at least one rotational assembly configured for rotating at least one of the laser head or the chemical compartment relative to a central axis of the tool body. In some embodiments, the tool includes a plurality of chemical compartments and a plurality of rotational systems, where the chemical compartments are separated by the rotational systems so that each chemical compartment can rotate independently.

In another aspect, the application relates to a method of using a tool to stimulate a hydrocarbon-bearing formation. The method includes the steps of positioning a hybrid tool within a wellbore within the formation, where the hybrid tool includes chemical delivery means and a laser head; passing, through one or more optical transmission media, a raw laser beam generated by a laser generating unit at an origin of an optical path comprising the one or more optical transmission media; orienting the laser head of the hybrid tool within the wellbore; delivering the raw laser beam to an optical assembly disposed within the laser head; manipulating the raw laser beam with the optical assembly to produce an output laser beam; delivering the output laser beam to the formation; orienting the chemical delivery means of the hybrid tool within the wellbore; triggering a chemical reaction within the hybrid tool to generate energy; and delivering the energy to the wellbore.

In various embodiments, the chemical reaction is triggered by at least one of heat or mixing of chemicals. The laser head can be oriented within the wellbore by using a plurality of nozzles disposed about an outer circumference of the laser head. Additionally, the step of positioning the hybrid tool within the wellbore can be carried out via an articulated arm and sensors.

DEFINITIONS

In order for the present disclosure to be more readily understood, certain terms are first defined below. Additional definitions for the following terms and other terms are set forth throughout the specification.

In this application, unless otherwise clear from context, the term "a" may be understood to mean "at least one." As used in this application, the term "or" may be understood to mean "and/or." In this application, the terms "comprising" and "including" may be understood to encompass itemized components or steps whether presented by themselves or together with one or more additional components or steps. As used in this application, the term "comprise" and variations of the term, such as "comprising" and "comprises," are not intended to exclude other additives, components, integers or steps.

About, Approximately: as used herein, the terms "about" and "approximately" are used as equivalents. Unless otherwise stated, the terms "about" and "approximately" may be understood to permit standard variation as would be understood by those of ordinary skill in the art. Where ranges are provided herein, the endpoints are included. Any numerals used in this application with or without about/approximately are meant to cover any normal fluctuations appreciated by one of ordinary skill in the relevant art. In some embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

In the vicinity of a wellbore: As used in this application, the term "in the vicinity of a wellbore" refers to an area of a rock formation in or around a wellbore. In some embodiments, "in the vicinity of a wellbore" refers to the surface area adjacent the opening of the wellbore and can be, for example, a distance that is less than 35 meters (m) from a wellbore (for example, less than 30, less than 25, less than 20, less than 15, less than 10 or less than 5 meters from a wellbore).

Substantially: As used herein, the term "substantially" refers to the qualitative condition of exhibiting total or near-total extent or degree of a characteristic or property of interest.

Circumference: As used herein, the term "circumference" refers to an outer boundary or perimeter of an object regardless of its shape, for example, whether it is round, oval, rectangular or combinations thereof.

These and other objects, along with advantages and features of the disclosed systems and methods, will become apparent through reference to the following description and the accompanying drawings. Furthermore, it is to be understood that the features of the various embodiments described are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosed systems and methods and are not intended as limiting. For purposes of clarity, not every component may be labeled in every drawing. In the following description, various embodiments are described with reference to the following drawings, in which.

DETAILED DESCRIPTION

This application is directed to a tool and related systems and methods to establish communications between a wellbore and a hydrocarbon bearing formation to improve production and increase a recovery factor in both conventional and unconventional reservoirs. The disclosed technology provides non-damaging alternative means for several downhole stimulations and applications, including drilling, notching, and fracture initiation. Generally, the laser tool is combined with chemical compartments disposed in a body of the tool that can discharge chemicals that are energized when mixed or triggered to deliver pressure and temperature energy to the formation. This energy can be used in different patterns and architectures to establish communication between a tight formation and the wellbore for production of hydrocarbons.

Figure 1:
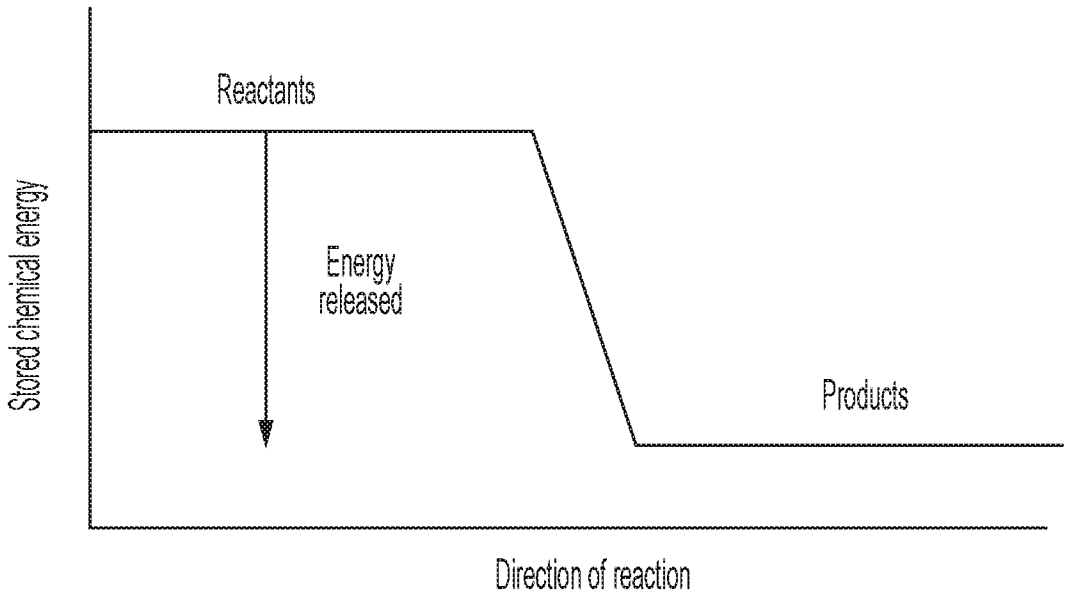
FIG. 1 is a graphical representation of the potential energy of the reactants as heat during a chemical reaction in accordance with one or more embodiments.

FIG. 1 graphical depicts the potential energy of the chemical reactants released as heat during chemical pulsed reaction. Generally, the atoms and molecules of chemicals have an energy that can be utilized for different applications. Some chemical reactions have the ability to release energy in different forms, such as heat, which is referred to as exothermic reactions. The heat that is released by exothermic reactions can be measured if the reactions take place at constant temperature and constant pressure. In chemistry, the released heat is called enthalpy and can be described by equation 1:

$$\Delta H = H_{products} - H_{reactants} \text{(where } H\text{=Heat).}$$

Many exothermic reactions produce gases among the products of the reaction. These kinds of reactions can do work on their surroundings, because of the pressure from the release of the gas, as shown in equation 2:

$$w = -P\Delta V \text{(where } w\text{=work, } P\text{=pressure, and } V\text{=volume)}$$

In addition, the pressure of released gas and volume can be calculated using the ideal gas law: PV=nRT, as known to those of skill in the art.

Accordingly, based on the foregoing information, a chemical reaction can be used to generate energy that can be used to create fractures in a formation, and the pressure and temperature of reaction can be estimated.

The following are examples of chemical reactions that produce a gas by mixing the chemicals together. The reaction of sodium nitrite ($NaNO_2$) and sulfamic acid ($HSO_3NH_2$) will produce nitrogen gas (along with sodium bisulfate and water) as shown in the following reaction:

$$NaNO_2 + HSO_3NH_2 \rightarrow N_2 + NaHSO_4 + H_2O.$$

A reaction between sodium bicarbonate ($NaHCO_3$) and acetic acid ($HC_2H_3O_2$) will produce carbon dioxide gas (along with sodium acetate and water) as shown in the following reaction:

$$NaHCO_3 + HC_2H_3O_2 \rightarrow NaC_2H_3O_2 + H_2O + CO_2.$$

Some chemicals require heat to start the reaction, for example, the decomposition of ammonium nitrite ($NH_4NO_2$). This reaction will take place very slowly at room temperature; however the reaction will occur extremely fast if triggered at a temperature of about 60-70° C., producing a very high amount of nitrogen gas as shown in the following reaction:

$$NH_4NO_2 => N_2 + H_2O.$$

Another example is the decomposition of sodium azide ($NaN_3$), which requires a temperature of about 300° C. to start the reaction as shown in the following reaction:

$$2NaN_3 = 2Na + 3N_2.$$

Figure 2:
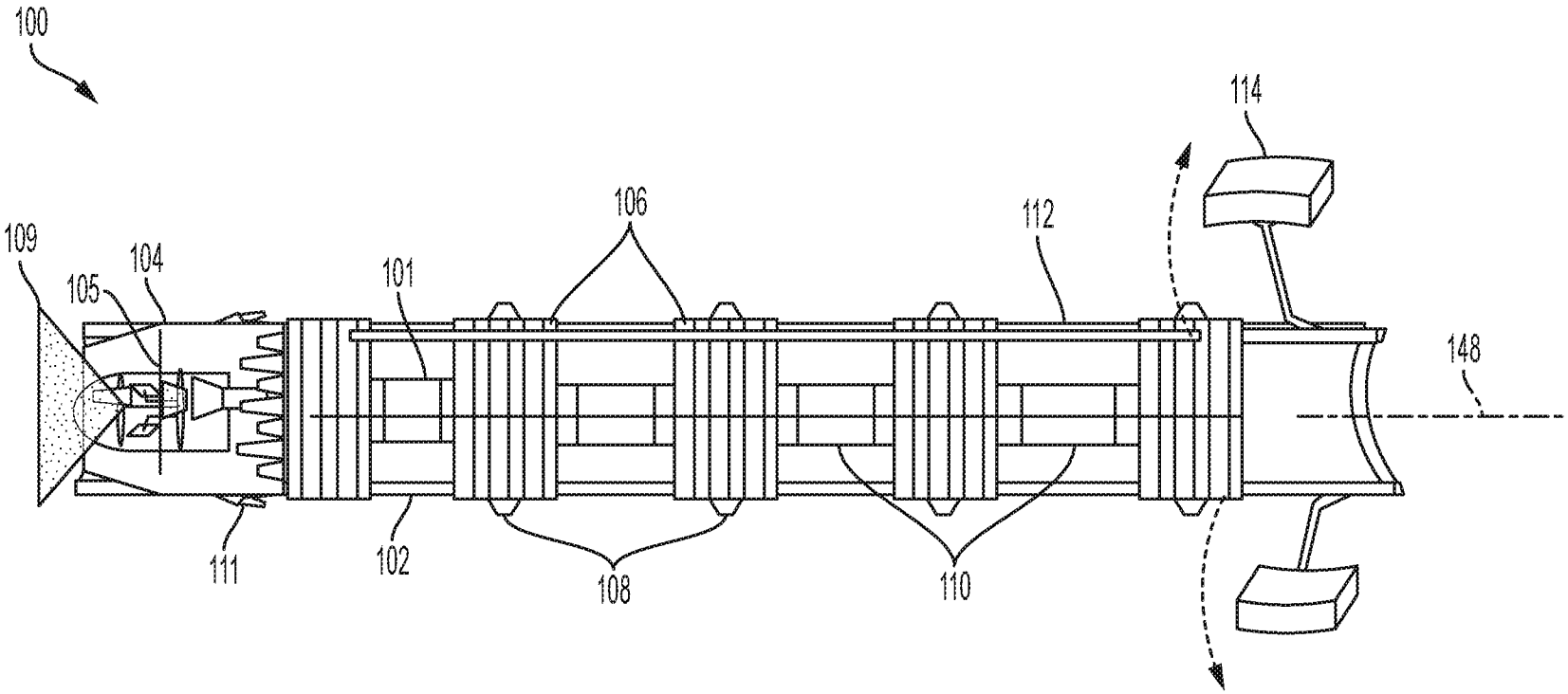
FIG. 2 is an enlarged schematic representation of a hybrid tool in accordance with one or more embodiments.

FIG. 2 depicts a hybrid tool 100 in accordance with one or more embodiments. As shown, the tool 100 includes an elongate body 102 that in some embodiments includes an articulated arm 101 as described in more detail later. FIG. 2 also depicts a laser head 104 coupled to a distal end of the tool body 102. The tool body 102 also includes one or more chemical reaction compartments 106 that are insulated and used to store and mix the chemicals. In some embodiments, there is a plurality of evenly spaced compartments 106 along a length of the tool body 102; however, the number and spacing can be selected to suit a particular application or reservoir. For example, if the tool 100 is being used for a tight reservoir, then the spacing of the compartments 106 will be closer and greater in number. The compartments are described in greater detail with respect to FIGS. 3-8.

With reference to FIGS. 2, 9A, 9B, and 10, the laser head 104 (904 in FIG. 9A) includes an optical assembly 105 (905 in FIG. 9A) in communication with a laser generating unit (544 in FIG. 10) via a cable assembly (546 in FIG. 10, 946 in FIG. 9A) the laser generating unit 544 is located on the surface 542 in the vicinity of the wellbore 544 and is configured to provide: the means to position and manipulate the tool assembly 100, 500, 900 within the wellbore 540; the controls and fluid (gas or liquid) source for a purging assembly 107 (907 in FIG. 9B) and the controls and means for delivering laser energy to the optical assembly 105. The cable assembly 546 provides the tool 100, 500, 900 with power (electric) and includes optical transmission media, such as optical fibers, for transmitting the laser energy to the tool. The cable is encased for protection from the downhole environment, where the cable casing can be made of any commercially available materials to protect the cable from high temperature, high pressure, and fluid/gas/particle invasion of the cable.

Generally, the laser head 104 (904 in FIG. 9B) includes a protective housing, which, in accordance with some embodiments, is a transparent housing formed of a glass or sapphire material. In some embodiments, only a distal end of the housing is transparent or includes a cover lens for emission of the output beam 109 (909 in FIG. 9A). The raw laser output end of the cable 546 is operably connected to the optical assembly 105 within the housing. The optical assembly 105 is used to shape and deliver an output laser beam 109 to the wellbore.

The optical assembly 105, 905 includes the various optical components, such as lenses, prisms, and a collimator as necessary to shape and size a desired output beam 109, 909. In some embodiments, the cover lens also protects the optical assembly 105, for example, by preventing dust and vapor from entering the laser head 104. The various optical components previously described can be any material, for example, glass, plastic, quartz, crystal or other material capable of withstanding the environmental conditions to which they are subjected. The shapes and curvatures of any lenses can be determined by one of skill in the art based on the application of downhole laser systems.

In some embodiments, in addition to the fiber optics for beam delivery 110, the cable 546 also includes another low power fiber optic cable 112 for heating. The power of this cable 112 can be less than 5 kW. The cable 112 has two functions: temperature and pressure measurements and logging; and to generate heat for a chemical reaction. The specific placement of the cable 112 on the tool 100 can vary to suit a particular application. In some embodiments, the cable 112 is disposed on an outer surface of the chemical compartments 106 to provide heat directly to the compartments 106.

The tool 100 depicted in FIG. 2 is configured to be lowered downhole via any service provider using a coiled tube unit, wireline, or tractors as known in the art. The tool 100 includes an articulated arm 101, which is sometimes referred to as a "snake robot." The fiber optic cable 110, 112 can be embedded in the articulated robotic arm 101 (901 in FIG. 9A), where the arm is powered by electricity or hydraulic actuators and the orientation of the tool 100, 900 is controlled by the orientation means 111 (911 in FIG. 9B) to be described below, or by the tool itself where it has built in motor(s) to orient the tool.

Additionally, not just the fiber optic cables, but the main cable 546, or at least a portion thereof, can be disposed or embedded within the robotic arm 101. The tool 100 or a portion thereof, such as the laser head 104, can also include one or more low power fiber optics sensors for temperature and pressure logging, and one or more acoustic cameras (903 in FIG. 9B) located around a circumference of the laser head 104. The function of the cameras is to visualize the laser head 104 and the surrounding area, along with characterizing the formation. The data captured from the acoustics (besides the images) are the velocities of the sound waves that travel and are reflected within the formation, which can be used to calculate the mechanical properties of the formation, predict the formation stability, evaluate tool performance, and support tool orientation and troubleshooting.

Generally, the acoustic sensing 903 can provide information while drilling and guide the tool (similar to geosteering) by measuring the densities of the formation. By knowing the density, the formation and structure will also be known. The integrated acoustics provide high definition reservoir characterization and mapping. For example, while the tool 100 is penetrating the formation, the tool will send live data to the surface to an operator, the operator can teach the tool 100 to stick to specific density ranges and not penetrate other ranges, for example, sandstone densities range between 2.2 to 2.6 grams per cubic centimeter (g/cc), so the tool will follow and penetrate only in sandstone and at the same time provide mapping of the sandstone structure. The acoustics also provide vision via the acoustic camera(s). These features enable the tool 100 to target hydrocarbon zones only. Also, the information provided via the acoustics can be used to calculate the mechanical properties of the formation and generate tomographic images. Machine learning can also be utilized to "teach" the tool how to self-navigate the formation via the information provided by the acoustics and fiber optic sensors 913.

Figure 9A:
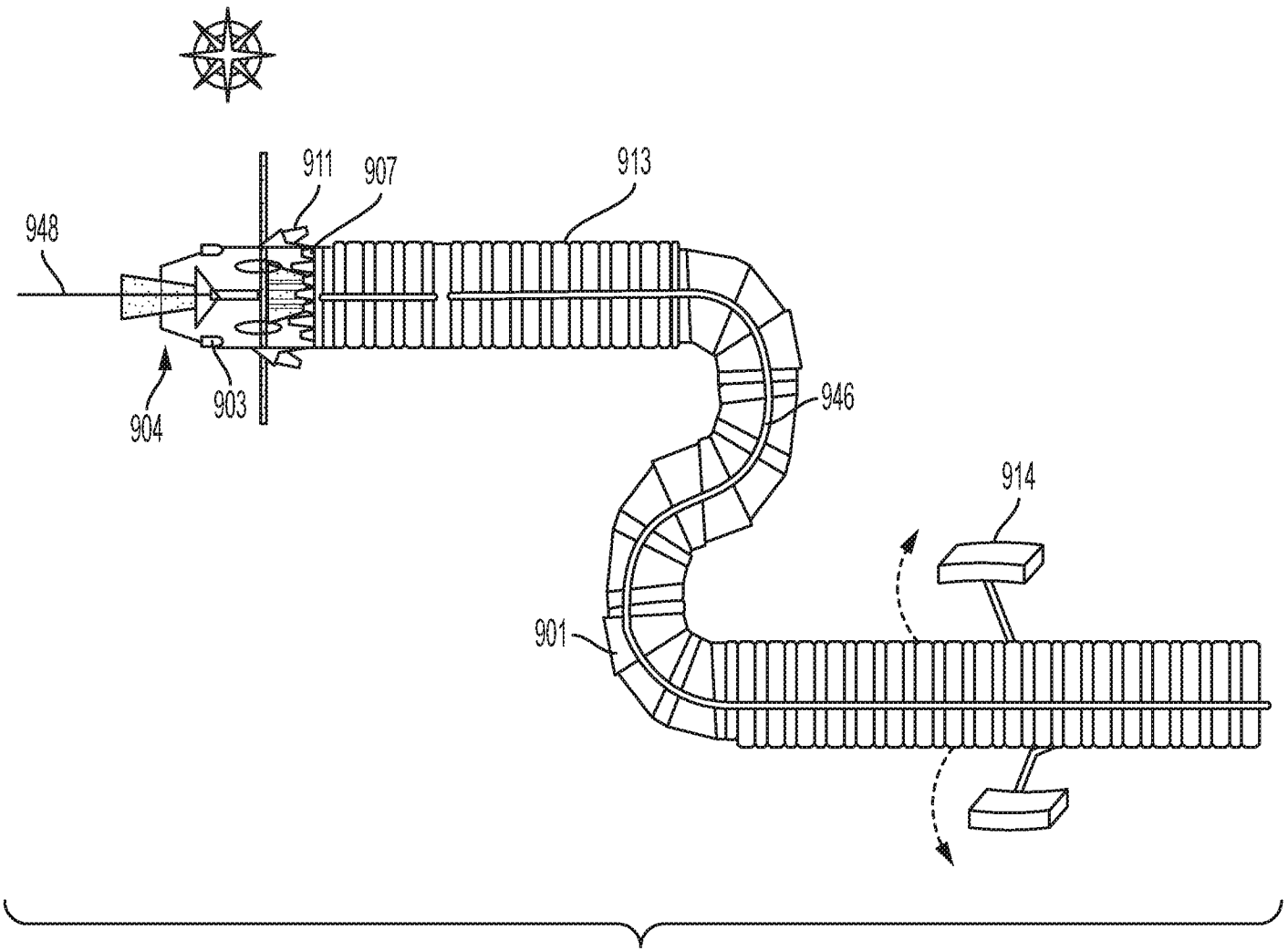
FIGS. 9A and 9B are enlarged schematic representations of portions of alternative hybrid tools in accordance with one or more embodiments.
Figure 9B:
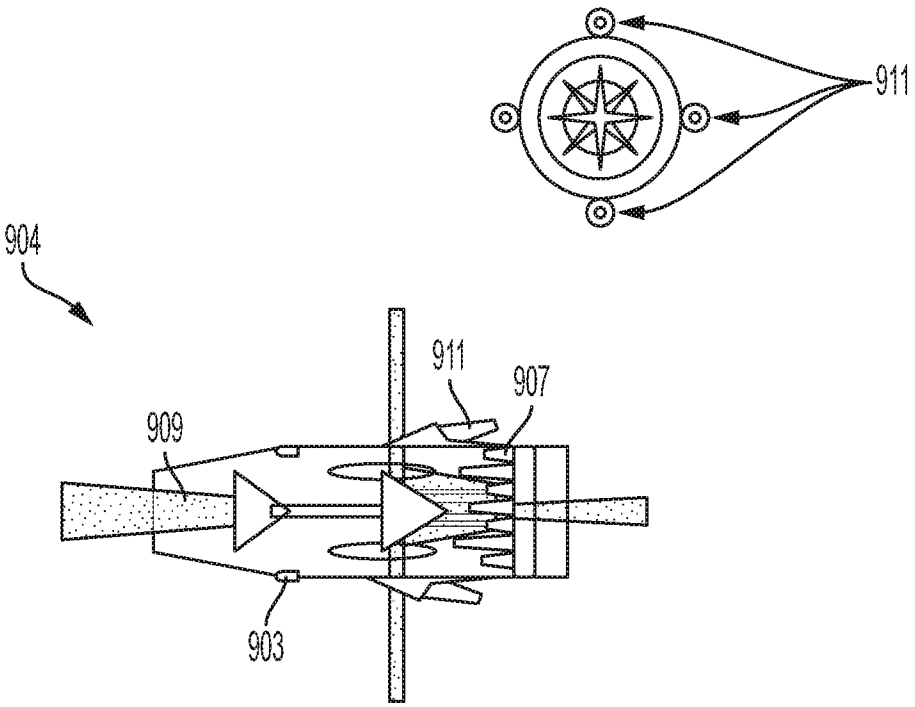

The tool 100 can be programmed to navigate and drill in specified rock densities, with the acoustic sensing and the sound waves used as a monitoring tool to steer the snake robot. More specifically, the tool 100 will send and receive sound waves, and from the velocity differences, the tool can be directed to the target formation or identify particular subsurface structures, because the data is sent directly to the surface to control the snake robot, or the snake robot can be preprogrammed to analyze the velocity and steer based on these sound waves. Further details of the disclosed snake robotics and acoustic sensing are depicted in FIGS. 9A and 9B, as referenced above.

Furthermore, the tool 100 can also include a plurality of orientation nozzles 111, 911 and a purging system 107, 907. The tool 100, 900 also includes centralizers or packers 114, 914 to centralize the tool 100, 900 and isolate a zone if needed to perform a specific task in that zone upon reaching a target. The centralizers 114, 914 can be disposed at various points along the tool 100, 900 as need to suit a particular application. The centralizers 114, 914 support the weight of the tool body and can be spaced along the tool 100, 900 as needed to accommodate the tool 100, 900 extending deeper into the formation. The centralizers 114, 914 can be metal, polymer, or any other suitable material. One of ordinary skill in the art will be familiar with suitable materials. In some embodiments, the centralizer 114, 914 can include a spring or a damper, or both. In some embodiments, the centralizer includes a solid piece of a deformable material, for example, a polymer or a swellable packer. In some embodiments, the centralizer is or includes a hydraulic or pneumatic device, such as a bladder.

One of the features of the tool 100 is its precise control over the motion and location of the laser head 104 within the wellbore. The tool 100 can also be positioned and oriented via the snake robot. Also provided are means for sensing the orientation and location of the tool 100 within the wellbore, such means including the various sensors and imaging as known to those of skill in the art.

In the embodiment shown, the orientation means 111, 911 include a plurality of nozzles disposed about the outer circumference of the laser head 104, 904. The nozzles may be coupled to the laser head 104, 904 housing via known mechanical means as either fixed (for example, via fasters or bonding) or movable (for example, via a ball joint or servo motors). Typically, the nozzles will be movably coupled to the laser head 104, 904 and controlled via a control system to provide forward, reverse, or rotational motion to the laser head 104, 904, and by extension the tool 100, 900.

Generally, the tool 100/head 104 is oriented by controlling a flow of a fluid (either liquid or gas) through the nozzles. For example, by directing the flow of the fluid in a rearward direction (opposite the direction of the output laser beam 109), the tool 100 will be pushed forward in the wellbore by utilizing thrust action, where the opening of the nozzles are facing the opposite directions of the tool head 104 and the fluid flows backward providing the thrust force moving the tool 100 forward. Controlling the flow rate will control the speed of the tool 100 within the wellbore. The fluid for providing the thrust can be supplied from the surface and delivered by a fluid line included within the cable 546.

In some embodiments, there are four (4) nozzles evenly spaced around the laser head 104 and each nozzle can be separately controlled. For example, if only one nozzle on, then the tool 100 will turn in a direction opposite of the nozzle. The turn degree depends on the controlled flow rate from that nozzle. If all of the nozzles are evenly turned on, then the tool will move linearly forward or in reverse depending on the position of the nozzles. See, for example, FIG. 9B.

As previously mentioned, the nozzles can be movably mounted to the laser head 104, for example, via servo motors with swivel joints that can control whether the nozzles ends face rearward (forward motion), forward (reverse motion), or at an angle to a central axis 148 (948 in FIG. 9A) of the tool 100 (rotational motion or a combination of linear and rotational motion depending on the angular displacement of the nozzle relative to the central). For example, if the nozzles are aligned perpendicular to the central axis 148, the nozzles will only provide rotational motion. If the nozzles are parallel to the central axis 148, then the nozzles will only provide linear motion. A combination of rotational and linear motion is provided for any other angular position relative to the central axis 148.

Referring back to FIG. 2, the purging assembly 107 includes a plurality of purge nozzles disposed within or proximate the laser head 104 and configured for removing dust or other particles from the exterior surface of the laser head and an area proximate to the laser head 104 to clear a path for the laser beam 109, as the debris will absorb energy, resulting in less energy delivered to the formation. Additionally, the debris can contaminate the cutting area and damage the laser head 104 or disrupt, bend, or scatter the laser beam 109. Suitable purging fluids may be gas, such as high pressure air, or liquids. The purge fluid should be transparent to the laser beam wavelength. In accordance with various embodiments, at least a portion of the nozzles are vacuum nozzles connected to a vacuum source and adapted to remove debris and gaseous fluids from around the exterior of the laser head 104.

Figure 3:
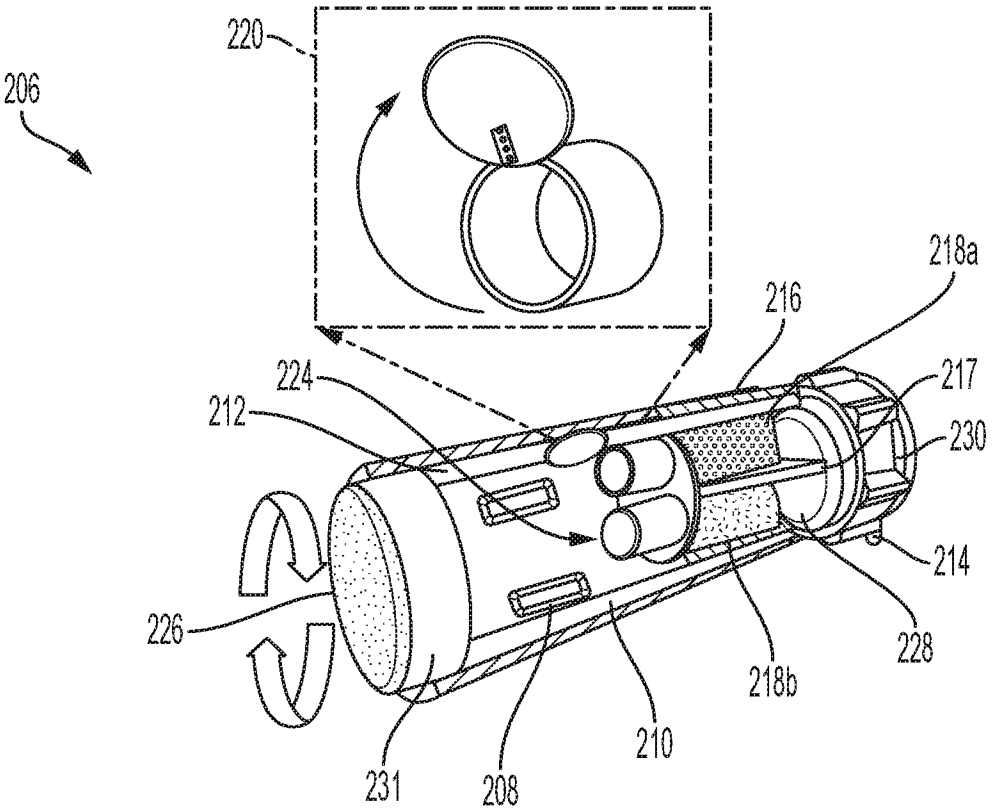
FIG. 3 is an enlarged and exploded schematic representation of a portion of a chemical compartment of the tool of FIG. 2 in a first stage of operation in accordance with one or more embodiments.

The chemical compartments 106, 206 are described in greater detail in FIGS. 3-8. FIG. 3 depicts a single compartment for mixing and triggering the reaction in a pre-mixing stage, with the chemicals in separate storage receptacles 218*a*, 218*b*. Generally, each compartment includes a rotational assembly 230 disposed at one end thereof to rotate the compartment to a target location as needed. In some embodiments, the compartments can pre-rotated to a set position before lowering the tool 200 or rotated in-situ by electric or hydraulic power controlled from the surface. The rotational assembly 230 can be used to rotate the compartment 206 relative to the tool body 102 and the other compartments.

Each compartment 206 can also include a centralizer(s) 214 to center and lock the tool at a desired target location to ensure accurate operation and orientation. A piston 228 is included to push the chemicals in the storage region 216. As shown in FIG. 3, the storage region 216 includes a separator/divider 217 to separate the region 216 into first and second chemical storage receptacles 218*a*, 218*b*. This arrangement is used where these chemicals are triggered by mixing, and the storage receptacles include one or more one-way valves 222 to allow the chemical pushed by the piston 228 to enter into the mixing compartment 224. The compartment 206 also includes relief valves 208 that are pre-set at certain pressures, where they act like rupture disks to allow the pressurized gas to be released into the formation. In some embodiments, the relief valves 208 can be pre-set to relieve at 200 psi, where the reaction can generate a pressure of 4000 psi.

The end of the compartment 206 includes an additional rotational head 231 to assist with the rotation of the compartment, so that they both rotate in the same direction. This end rotational head 231 can be equipped with a reinforced plug 226 to prevent the energy from leaking or otherwise exiting the tool 200 in an unwanted direction or damage the tool. This compartment 206 is designed to have chemicals mix to trigger the reaction, in other embodiments, the chemicals are triggered by heat, where a fiber optic heating cable 212 is used to generate heat to trigger the reaction; however, other heat sources can be used, such as microwave or filament. The other fiber optic cable 210 shown is the main fiber optics to deliver the raw beam to the laser head.

Figure 4:
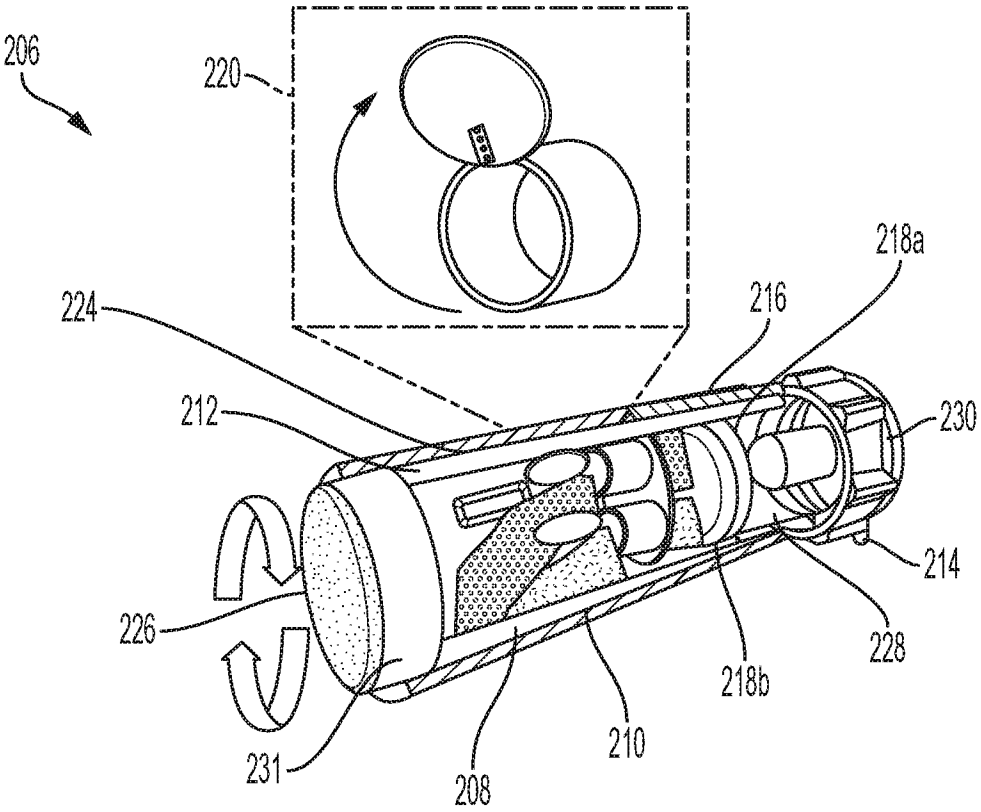
FIG. 4 is an enlarged and exploded schematic representation of the portion of the chemical compartment of the tool of FIG. 2 in a second stage of operation in accordance with one or more embodiments.

FIG. 4 depicts the compartment 206 of FIG. 3, but with the piston 228 in operation, such that the chemicals are being pushed through the one-way valves 222 into the mixing compartment 224 by the forward movement of the piston 228. The piston 228 can be moved hydraulically, pneumatically, or via an electric actuator. The pushing of the chemicals into the mixing compartment 224 should be done quickly; so that all of the chemicals enter the compartment 224 ensuring all the volumes are present in the compartment for the necessary reaction.

Typically, the chemicals are loaded into the tool at the surface, with the tool then lowered and stabilized in the wellbore at the desired target zone or zones. In some embodiments, the tool may include the necessary plumbing to introduce the chemicals into the tool after it has been positioned; for example, where multiple, repetitive reactions are desired.

Figure 5:
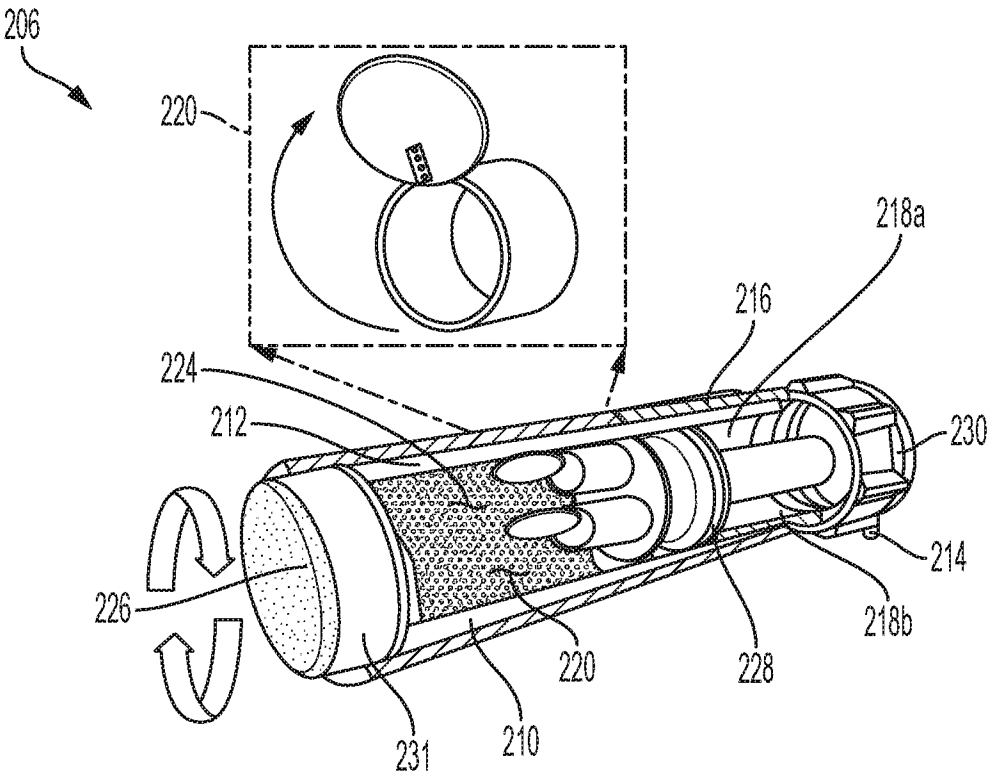
FIG. 5 is an enlarged and exploded schematic representation of the portion of the chemical compartment of the tool of FIG. 2 in a third stage of operation in accordance with one or more embodiments.

FIG. 5 depicts the compartment 206 of FIG. 3, but where the piston 228 has been completely advanced and the chemicals mixed, triggering the reaction. As can be seen in FIG. 5, the chemicals 220 are both in the mixing compartment 224, where the chemicals will react. The one or more relief valves 208 will open to release the chemicals and close after all of the chemicals have been released. The one-way valves 222 will close when the fluid in the mixing compartment 224 push them back, which is due to the force from the chemical reaction.

Figure 6:
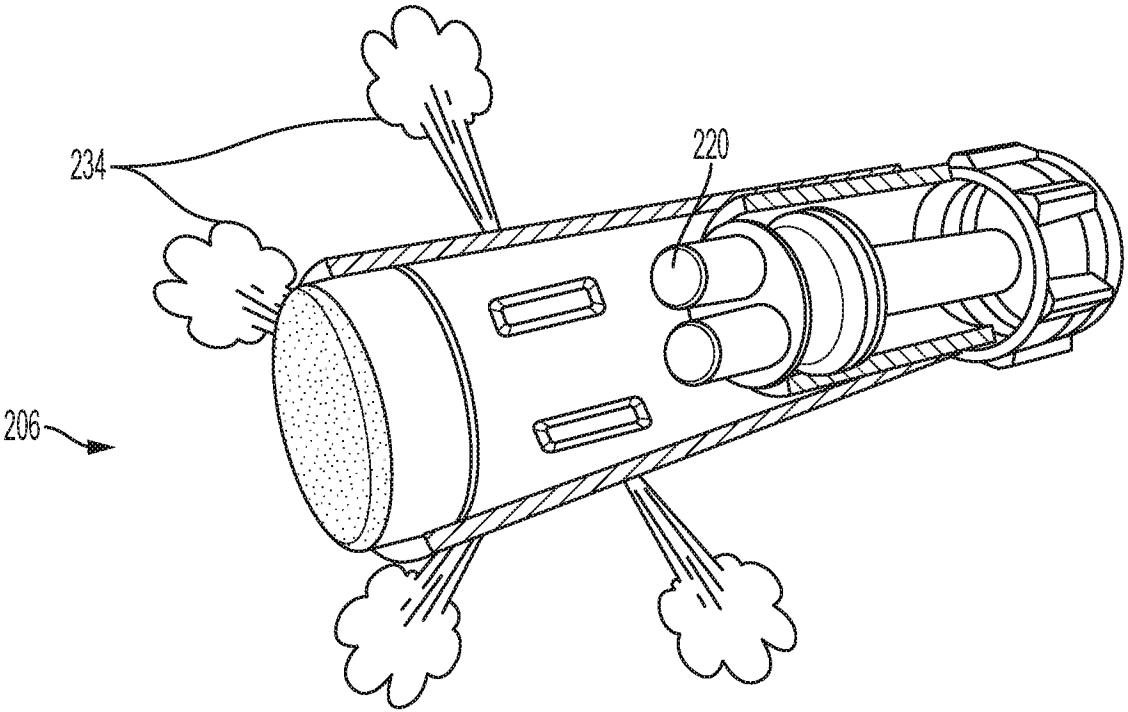
FIG. 6 is an enlarged schematic representation of the portion of the chemical compartment of the tool of FIG. 2 in a fourth stage of operation in accordance with one or more embodiments.

FIG. 6 depicts the stage at which all or at least substantially all of the chemicals have mixed, reacted, and been released as fracturing energy 234 via the relief valves 208. In some embodiments, the chemical reaction releases nitrogen gas; however, other chemicals may be used to release different gases to suit a particular application. Generally, the compartment 206 is now empty and needs to be reloaded for additional applications, which may be done on the surface after removing the tool form the wellbore or via chemical lines in fluid communication with the compartment 206 for reloading from the surface.

Figure 7:
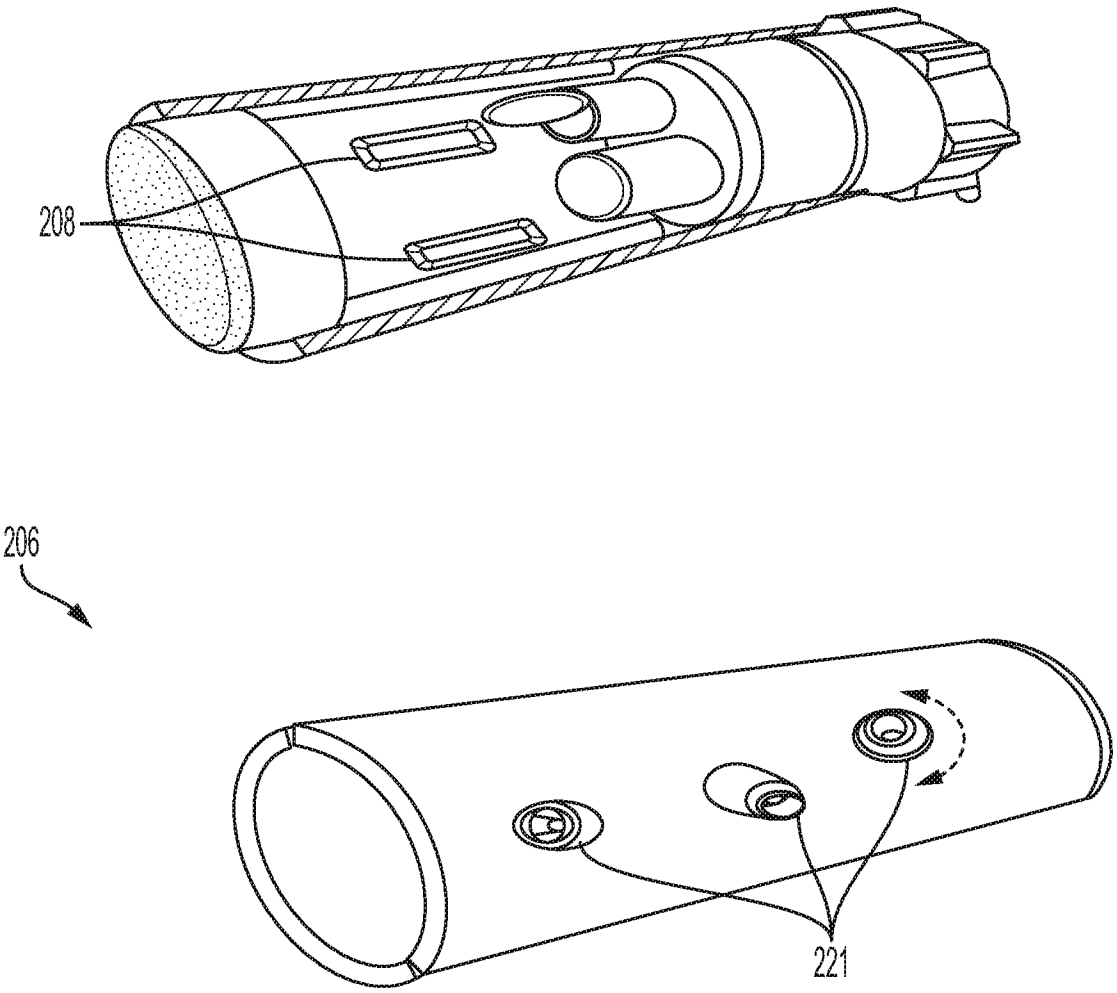
FIG. 7 is an enlarged schematic representation of a portion of a chemical compartment of the tool of FIG. 2 illustrating an external configuration of the valves in accordance with one or more embodiments.

FIG. 7 depicts an internal and external view of the compartment 206 to illustrate the relief valves 208. As shown, the compartment 206 includes 3 relief valves; however, any number or configuration can be selected to suit a particular application. The relief valves 208 include external ports 221 that can be oriented to control the direction of the pressure being released.

Besides the ability of the compartment 206 to orient and rotate, the external ports 221 of the relief valves 208 can be oriented up to 360 degrees for more specific targeting, for example, usually in a heterogeneous reservoir and applications where more energy and more than one valve are needed. Specifically, the external ports 221 can be oriented at the same target to provide maximum energy, for example in the case of a very strong formation, where the energy required may be very great and one valve might not be sufficient to release enough energy. As shown in FIG. 7, two or more valve ports 221 are adjusted in the same direction to release maximum energy at the specific target. The nozzle orientations can be pre-set at the surface or can be oriented in-situ via the control system.

Figure 8:
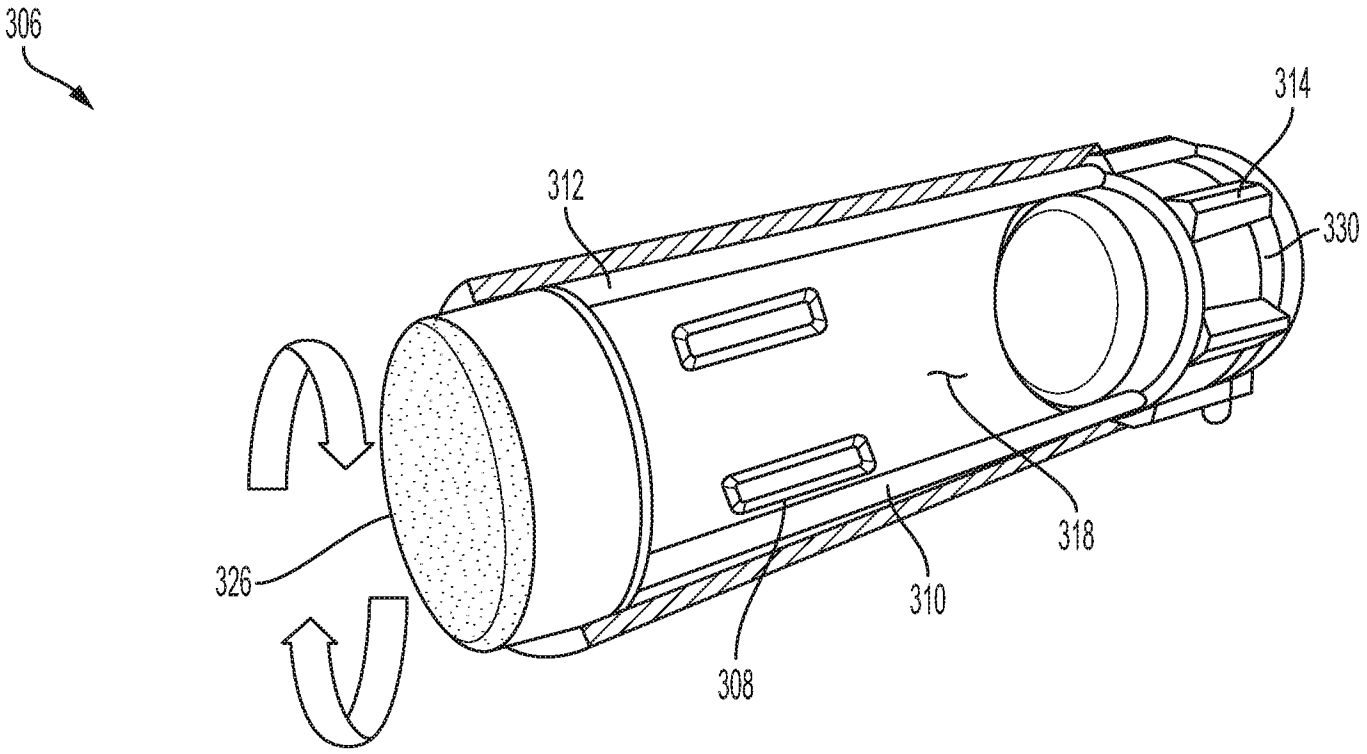
FIG. 8 is an enlarged schematic representation of a portion of an alternative chemical compartment of a hybrid tool in accordance with one or more embodiments.

FIG. 8 depicts an alternative compartment 306, where the reaction is triggered based on heating or timing, so that no pistons or one-way valves are required in this configuration. Otherwise, the compartment 306 is similar to compartment 206 insofar both include rotational assemblies 330, centralizers 314, a reinforced plug 326, relief valves 308, and chemical storage 318. In applications where the chemicals are triggered by time or heat, as shown in FIG. 8, the compartment 306 uses the heating fiber optic cable 312 to heat up the mixture, as the chemicals are already mixed and no piston or one-way valves are required. In some embodiments, the previously described compartments 206 can be used by disabling the piston 228 with the chemicals directly stored in the mixing compartment 224. The relief valves 308 are still used to release the energy to the target. In some embodiments, the fiber optic cable 312 transmits about 5 kilowatts (kW) of energy at a high power loss. The loss is in the form of heating, which will trigger the chemical reaction.

Figure 10:
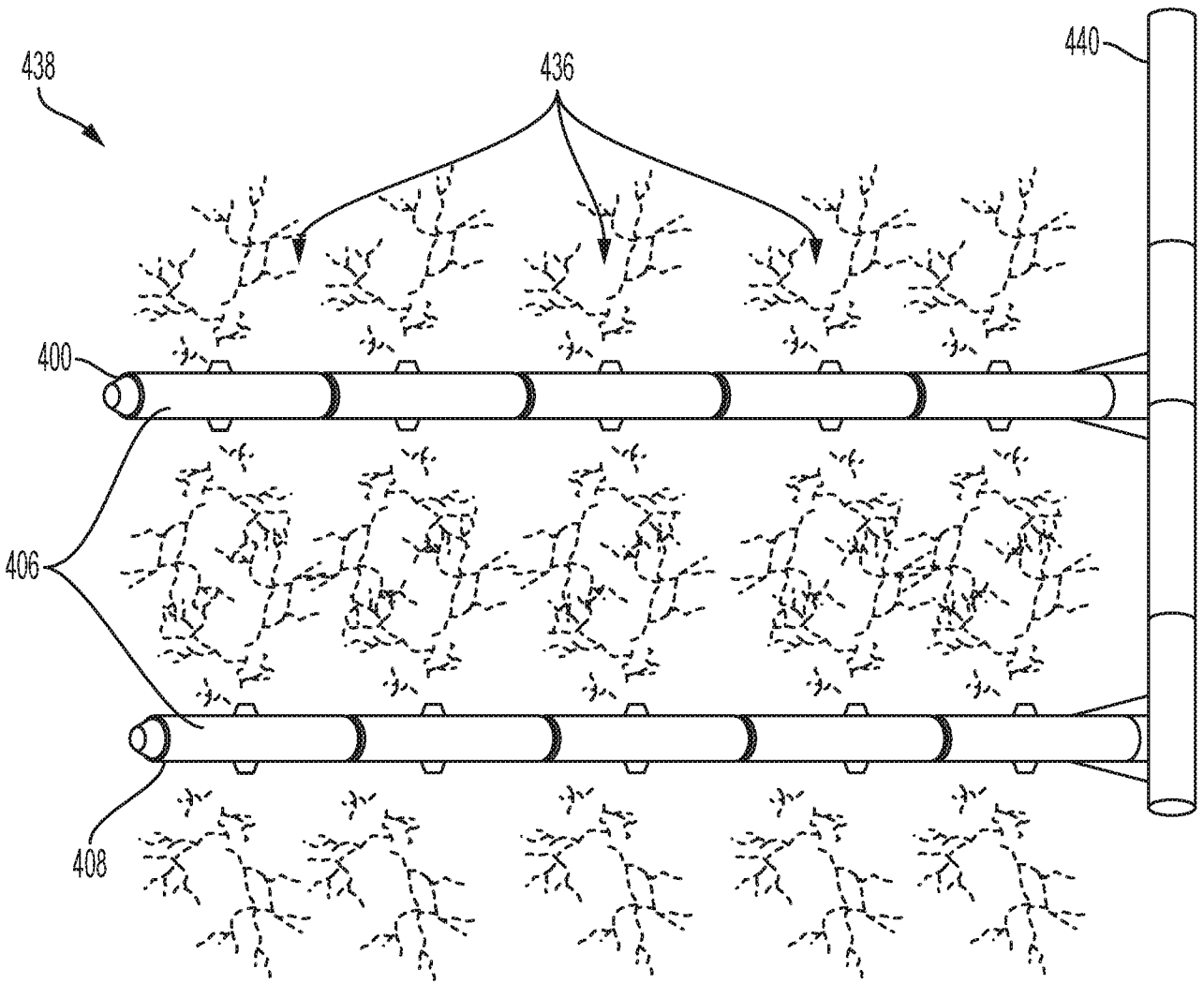
FIG. 10 is a pictorial representation of a deployment of a hybrid downhole tool in accordance with one or more embodiments.

FIG. 10 depicts one method of operating the disclosed tools in accordance with one or more embodiments. Generally, the tool(s) are used in existing wellbores or other open holes. In the method shown in FIG. 10, two (2) tools 400 are being used to carry out multistage fracturing, where two (2) horizontal wells 440 are drilled in a tight (low permeability, less than 2 millidarcies) or in a conventional reservoir. The tools 400 are used to drill the wellbores or to position the tools within existing wellbores via the laser head portion of the tool 400. Once the chemical compartments 406 are positioned in the target location, the chemicals can be triggered or otherwise reacted to release gas pulses via the relief valves 408 creating fractures. These various fractures connect as a web establishing a fracture network 436 between the formation 438 and the wellbore 440 for production.

Figure 11:
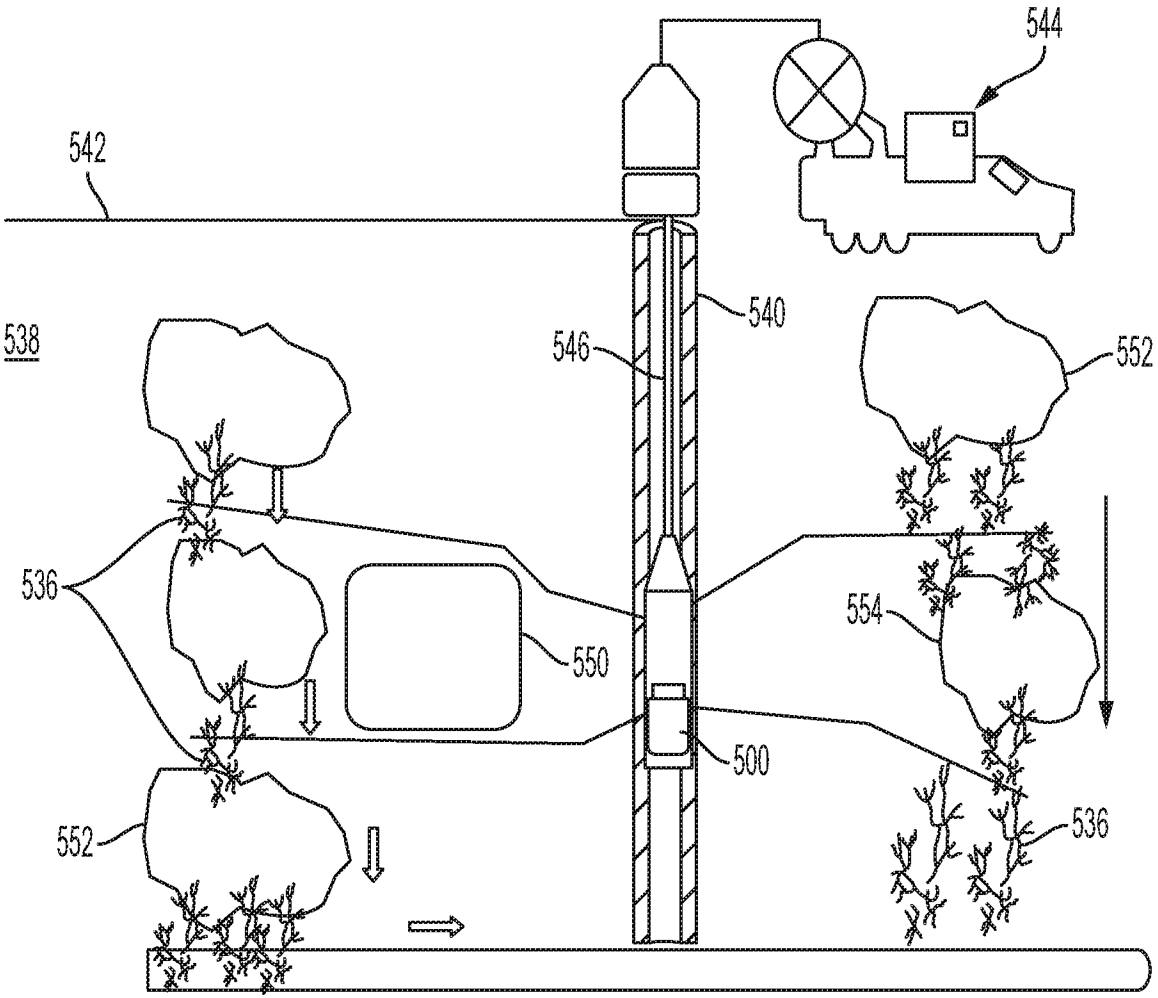
FIG. 11 is a pictorial representation of a method of using a hybrid downhole tool in accordance with one or more embodiments.

FIG. 11 depicts a method of using a tool in accordance with one or more embodiments, where the tool 500 can be used to bypass certain non-paying zones, such as water zones 550, faults, and high permeability channels using the snake robotics and acoustic sensors previously described. The tool 500 can also be operated to target oil zones 552 pockets (sweet spots) similar to the ones with high total organic carbon (TOC) in shale. In addition, the fracture can be conducted in low permeability zone 554 of the formation 538, connecting the oil zones 552, such that the oil will flow though the fracturing network 536 and be produced to the well via gravity.

Figure 12:
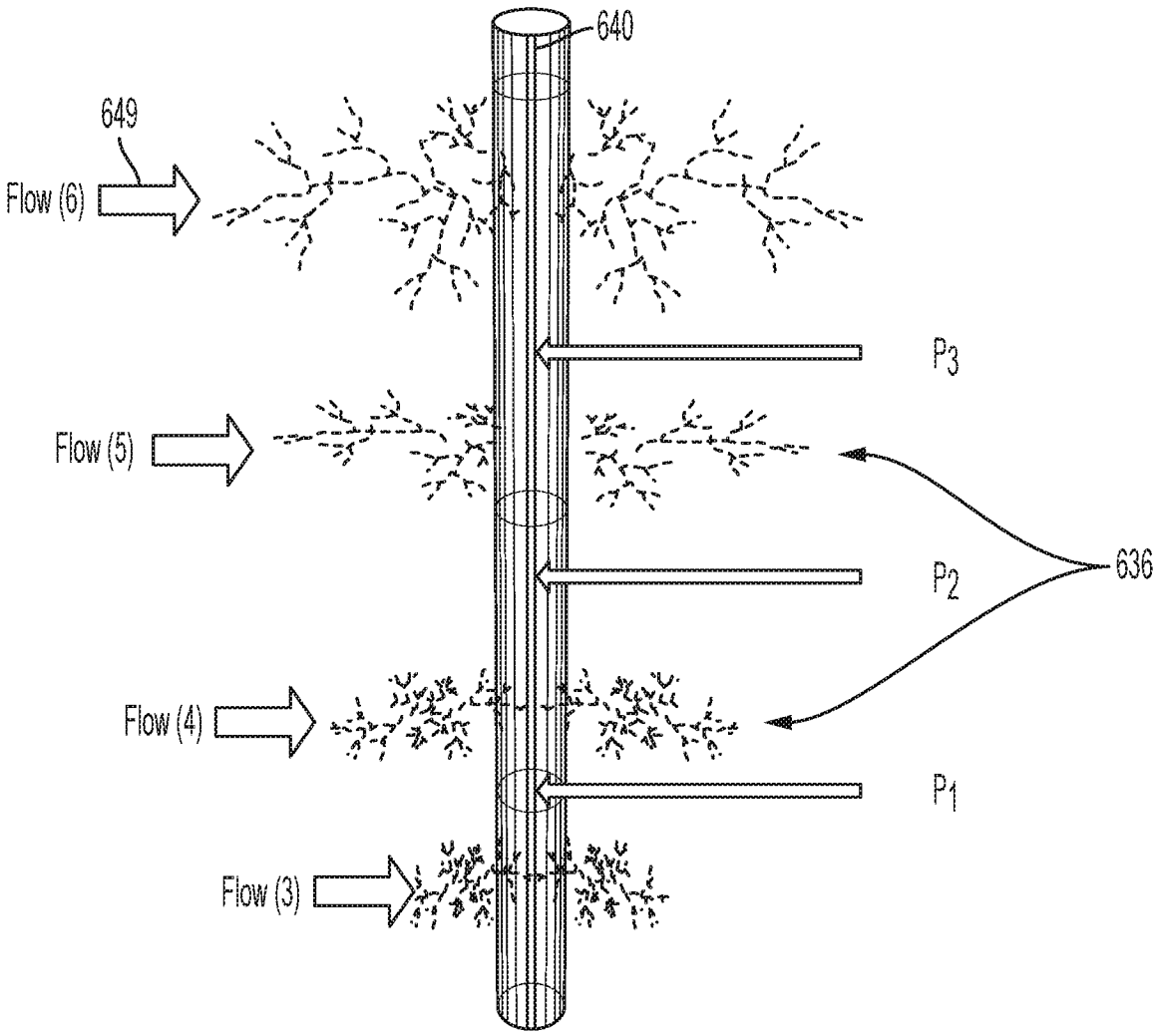
FIG. 12 is a pictorial representation of a fracturing network created by a hybrid downhole tool in accordance with one or more embodiments.

FIG. 12 depicts yet another application of using the tool, where the fracturing occurs at a different intensity then as shown in FIG. 11, which can be applied in both vertical and horizontal wells. The tool can be operated to cause fractures to be formed with different half-lengths to create an alternative fracturing network 636. In some embodiments, it is more advantageous to place longer fractures at the top (heel) of the wellbore 640 than the bottom (toe) when the flow 649 is relatively high or the wellbore is significantly slim. One reason why, is that the pressure toward the top (heel) of the wellbore 640 is higher than the bottom (toe) due to fluid hydraulics. For example, heel pressure P3 is greater than P2, which is greater than toe pressure P1. In other words, it is more difficult for hydrocarbons coming from flow 649 level 6 to be produced, than from flow levels 5 or 4, etc. Moreover, the deeper the fractures reach, the larger the effective radius will be and less draw down will be required. This will ensure a uniform sweep of the drainage area beyond the near wellbore area, minimizing fingering and coning toward the wellbore.

Figure 13A:
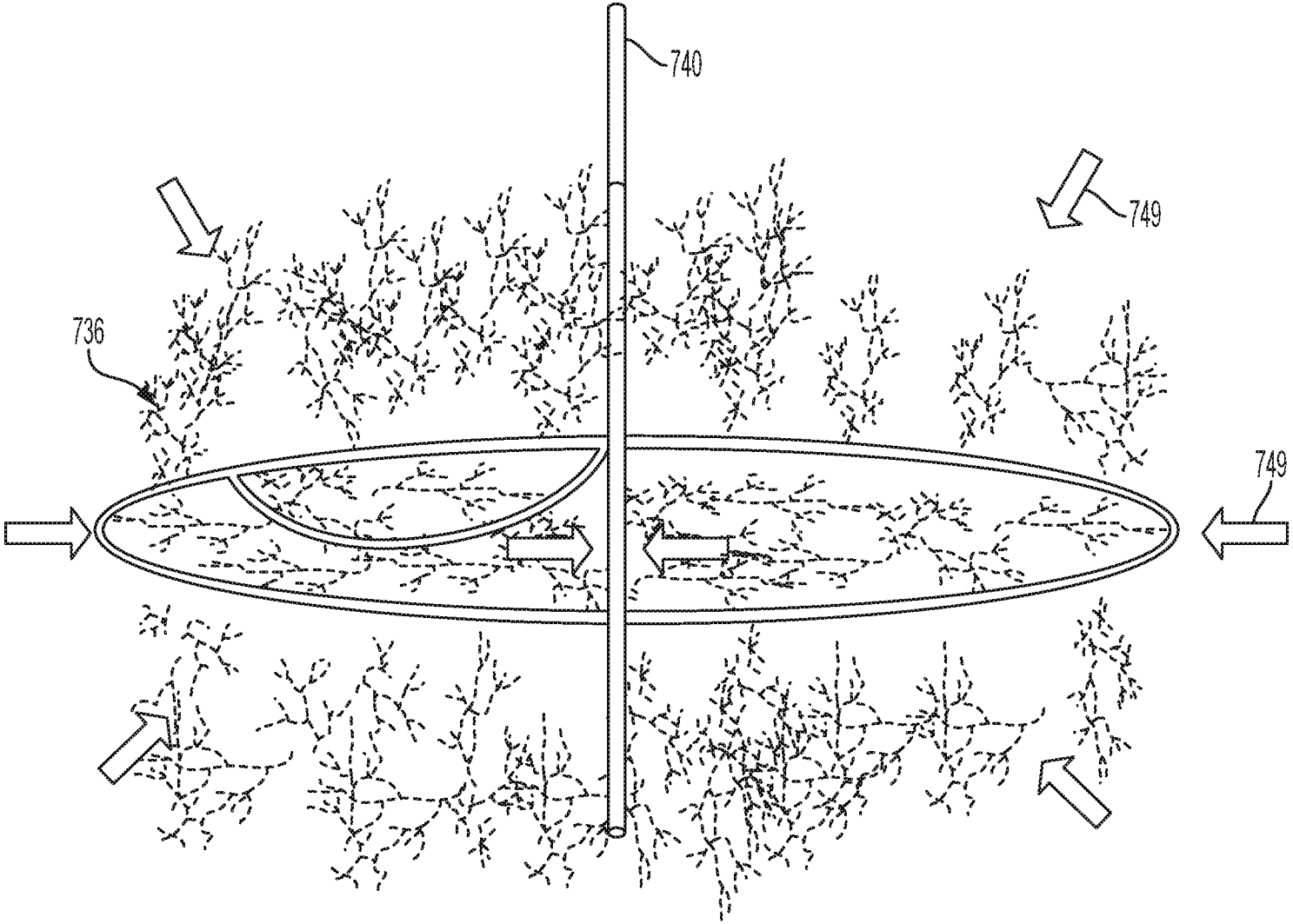
FIGS. 13A and 13B are pictorial representations of a fracturing network created by a hybrid downhole tool for radial flow in either a vertical or horizontal orientation.
Figure 13B:
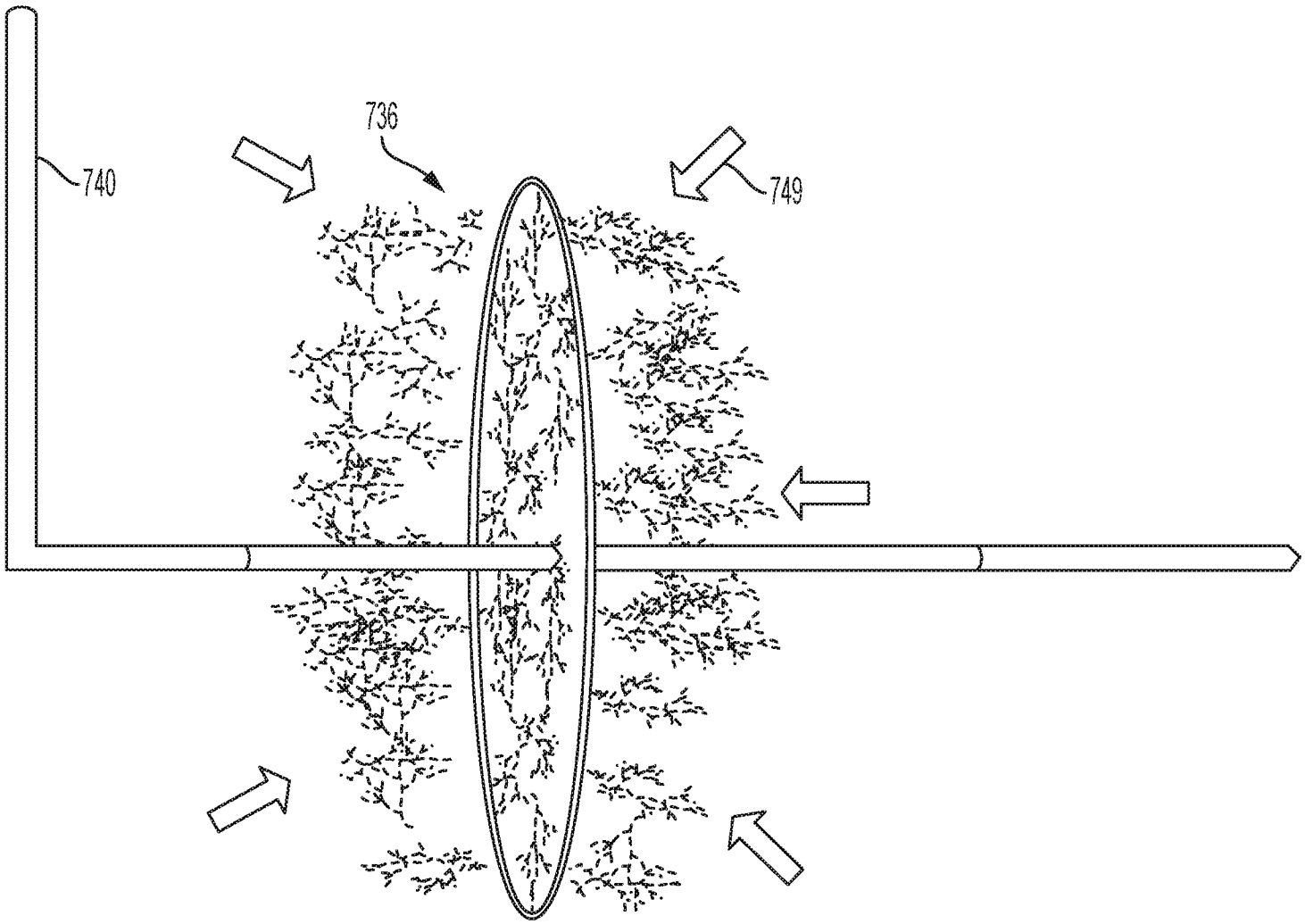

FIGS. 13A and 13B depict the current practice of hydraulic fracturing in a network 736 that propagates along a maximum horizontal stress, opening against the minimum horizontal stress directions based on the stress field around the wellbore 740 at the time of pumping. In horizontal wells, we may place multiples of these fractures (see FIG. 12B). In some instances, the fracture may not be initiated, due to a high breaking pressure point or deviation from an ideal, perpendicular plane around the wellbore 740. Even worse, it may not reach the optimum half-length by design. If the fracture is placed successfully, proppants should be introduced to keep the fracture open, which will also create more stress and eventually will close on the added material. The tools and related systems and methods disclosed herein provide the ability to create a radial fracture that is placed in the right setting and at the desired depth regardless of the orientation of field stresses around the wellbore 740. This creates a truly effective wellbore radius, which will maximize the productivity of the well. In addition rock material is removed, which eliminates the need to place proppants.

A flow 749 toward a well can be expressed in Darcy's law:

$$q = c\frac{kh}{\mu B_o}\frac{(P_r - P_{wf})}{\ln\left(\frac{r_e}{r_{eff}}\right)}$$

(where, q is flow rate, c is conversion factor, k is permeability, h is the height of production zone, μ is viscosity, $B_o$ is the formation volume factor, $P_r$ is reservoir pressure, $P_{wf}$ is the wellbore flowing pressure, $r_e$ is the reservoir extend. and $r_{eff}$ is the effective wellbore radius).

The effective wellbore radius is the radius of the well that can be recalculated from testing the flow of the well. It will be equal to the actual radius if the well is not damaged or enhanced around the wellbore. If there is damage, it will be smaller than the actual radius and larger if there is enhancement. In the case here of hydraulic fracture, the effective wellbore radius can be calculated as:

$$r_{weff} = \frac{x_F}{2}$$

(where, $r_{weff}$ is the effective wellbore radius and $x_F$ is the fracture half length).

Keeping in mind that conventional hydraulic fractures create damage around the created fracture, as long as the effective radius is significantly higher than the actual radius, the process is still considered a success. Using the tool, systems, and methods disclosed herein, creating a radial fracture of half of $x_F$ should mathematically give similar results to that of a hydraulic fracture, but without the need of a large amount of water, proppants, and horsepower. From a practical point of view, creating the micro fractures and enhancements due to this non-damaging technology, smaller radii may result in similar effective radii.

In some embodiments of the methods disclosed herein, the drilling can be carried out by either using a high power laser tool or conventional drilling and completions tools. The laser tool is equipped with high power fiber optics and beam delivery means to drill, as previously described. If conventional drilling is used and the tool is used for fracturing, then the tool can be used without the high power laser capability. In both cases, the tool can store and carry chemicals in specially designed insulated compartments. When the tool is used to drill, the tool can penetrate the formation at any orientation regardless of the strength of the formation and have the capability to deliver high power laser energy to create holes or tunnels.

In general, the construction materials of the downhole hybrid tool and related systems can be of any types of materials that are resistant to the high temperatures, pressures, and vibrations that may be experienced within an existing wellbore, and that can protect the system from fluids, dust, and debris. One of ordinary skill in the art will be familiar with suitable materials.

The laser generating unit can excite energy to a level greater than a sublimation point of the hydrocarbon bearing formation, which is output as the raw laser beam. The excitation energy of the laser beam required to sublimate the hydrocarbon bearing formation can be determined by one of skill in the art. In some embodiments, the laser generating unit can be tuned to excite energy to different levels as required for different hydrocarbon bearing formations. The hydrocarbon bearing formation can include limestone, shale, sandstone, or other rock types common in hydrocarbon bearing formations. The discharged laser beam can penetrate a wellbore casing, cement, and hydrocarbon bearing formation to form, for example, holes or tunnels.

The laser generating unit can be any type of laser unit capable of generating high power laser beams, which can be conducted through a fiber optic cable, such as, for example, lasers of ytterbium, erbium, neodymium, dysprosium, praseodymium, and thulium ions. In some embodiments, the laser generating unit includes, for example, a 5.34-kW Ytterbium-doped multi-clad fiber laser. In some embodiments, the laser generating unit can be any type of laser capable of delivering a laser beam at a minimum loss. The wavelength of the laser generating unit can be determined by one of skill in the art as necessary to penetrate hydrocarbon bearing formations.

The hybrid tool can also include a motion system that lowers the tool to a desired elevation within the wellbore. In various embodiments, the motion system can be in electrical or optical communication with the laser generating unit; such that the motion system can relay its elevation within the wellbore to the laser generating unit and can receive an elevation target from the laser generating unit. The motion system can move the tool up or down to a desired elevation and can include, for example, a hydraulic system, an electrical system, or a motor operated system to drive the tool into a desired location. In some embodiments, controls for the motion system are included as part of the laser generating unit. In some embodiments, the laser generating unit can be programmed to control placement of the tool based only on a specified elevation target and a position target. In some embodiments, the tool can receive an elevation target from the laser generating unit and move to the elevation target.

At least parts of the tools, systems, methods and their various modifications may be controlled, at least in part, by a computer program product, such as a computer program tangibly embodied in one or more information carriers, such as in one or more tangible machine-readable storage media, for execution by, or to control the operation of, data processing apparatus, for example, a programmable processor, a computer, or multiple computers, as would be familiar to one of ordinary skill in the art.

It is contemplated that systems, devices, methods, and processes of the present application encompass variations and adaptations developed using information from the embodiments described in the following description. Adaptation or modification of the methods and processes described in this specification may be performed by those of ordinary skill in the relevant art.

Throughout the description, where compositions, compounds, or products are described as having, including, or comprising specific components, or where processes and methods are described as having, including, or comprising specific steps, it is contemplated that, additionally, there are articles, devices, and systems of the present application that consist essentially of, or consist of, the recited components, and that there are processes and methods according to the present application that consist essentially of, or consist of, the recited processing steps.

It should be understood that the order of steps or order for performing certain action is immaterial so long as the described method remains operable. Moreover, two or more steps or actions may be conducted simultaneously.

What is claimed:

1. A hybrid tool for stimulating a hydrocarbon-bearing formation, the tool comprising:

an elongate tool body comprising a plurality of evenly spaced and insulated chemical compartments along a length of the tool, the chemical compartments comprising:

storage means for storing at least one chemical for reaction and delivery to a wellbore of the formation; and delivery means for delivering a product of the chemical reaction to the wellbore, where the product of the chemical reaction comprises a mix of two or more chemicals; and a laser head coupled to a distal end of the tool body and configured to operate within the wellbore, the laser head comprising:

one or more optical transmission media, the one or more optical transmission media being part of an optical path originating at a laser generating unit configured to generate a raw laser beam, the one or more optical transmission media configured for passing the raw laser beam; and an optical assembly coupled to the optical transmission media and configured to shape a laser beam for output.

2. The tool of claim 1, where the storage means of the chemical compartments comprise:

two receptacles configured for storing two or more chemicals for mixing;

a piston configured for advancing within the two receptacles to eject the chemicals from the two receptacles to the mixing compartment; and a one-way valve disposed on a distal end of each of the two receptacles configured for passing the chemicals to the mixing compartment.

3. The tool of claim 1, where the delivery means comprises one or more relief valves disposed in a wall of each of the chemical compartments, where the one or more relief valves are pre-set at certain pressures such that the one or more relief valves act like rupture disks to allow the pressurized gas to be released into the formation.

4. The tool of claim 1, where the chemical compartments further comprise a rotational assembly to orient the chemical compartments and delivery means towards a desired target, and where the chemical compartments comprise a centralizer to center and lock the tool at the desired target location to ensure accurate operation and orientation.

5. The tool of claim 3, where the chemical compartments further comprise heating means for triggering a reaction of the one or more chemicals stored therein, where the one or more relief valves are pre-set to relieve at about 200 psi, and where the chemical reaction generates a pressure of about 4000 psi.

6. The tool of claim 1, where the laser head further comprises a housing that contains at least a portion of the optical assembly, the housing being configured for movement within the wellbore to direct the laser beam relative to the wellbore.

7. The tool of claim 1, where the laser head further comprises a plurality of orientation nozzles disposed about an outer circumference of the laser head, the plurality of nozzles configured to provide thrust to the laser head to control motion and orientation of the tool within the wellbore.

8. The tool of claim 7, where the plurality of orientation nozzles are movably coupled to the laser head to allow the orientation nozzles to rotate or pivot relative to the laser head to provide forward motion, reverse motion, rotational motion, or combinations thereof to at least the laser head.

9. The tool of claim 1, where the laser head further comprises a purging assembly disposed at least partially within or adjacent to the laser head and configured for delivering a purging fluid to an area proximate the output laser beam, the purging assembly comprising purge nozzles.

10. The tool of claim 9, where at least a portion of the purge nozzles are vacuum nozzles connected to a vacuum source and configured to remove debris and gaseous fluids from the area proximate the output laser beam.

11. The tool of claim 1, further comprising at least one centralizer coupled to the tool and configured to hold the tool in place relative to an outer casing in the wellbore.

12. The tool of claim 1, where the tool comprises an articulated arm disposed between the laser head and the laser generating unit.

13. The tool of claim 12, where the articulated arm comprises a snake robot having locomotion means for maneuvering the tool within the wellbore.

14. The tool of claim 13, where the locomotion means comprises at least one of an electrical motor or a hydraulic actuator.

15. The tool of claim 1 further comprising a control system configured to control at least one of a movement or an operation of the tool.

16. The tool of claim 1 further comprising at least one rotational assembly configured for rotating at least one of the laser head or the chemical compartment relative to a central axis of the tool body.

17. The tool of claim 1 further comprising:

a plurality of chemical compartments; and a plurality of rotational systems, where the chemical compartments are separated by the rotational systems so that each chemical compartment can rotate independently.

18. The tool of claim 1 further comprising:

one or more acoustic cameras located around a circumference of the laser head;

where the one or more acoustic cameras visualize the laser head and the surrounding area, where the one or more acoustic cameras characterize the formation based on a visualization of the laser head and surrounding area, where data captured from the acoustics comprise velocities of the sound waves that travel through, and are reflected within, the formation, and where the velocities of the sound waves are used to calculate the mechanical properties of the formation, predict the formation stability, evaluate tool performance, and support tool orientation and troubleshooting.

19. The tool of claim 18, where the one or more acoustic cameras provide information while drilling and guide the tool by measuring the densities of the formation; and where the one or more acoustic cameras are used to generate tomographic images.

20. The tool of claim 18, where the tool is programmed to navigate and drill in specified rock densities, where acoustic sensing data and the sound waves are used as a monitoring tool to steer a snake robot.

21. A system for stimulating a hydrocarbon-bearing formation, the system comprising:

one or more hybrid tools for deployment within a wellbore of the formation, the one or more hybrid tools comprising:

an elongate tool body comprising a plurality of evenly spaced and insulated chemical compartments along a length of the one or more hybrid tools, the chemical compartments comprising:

two receptacles for storing at least one chemical for use in a chemical reaction; and one or more relief valves disposed in a wall of the chemical compartment for controlling the delivery of a product of the chemical reaction to the wellbore, where the product of the chemical reaction comprises a mix of two or more chemicals; and a laser head coupled to a distal end of the elongate tool body and configured to operate within the wellbore.

22. The system of claim 21, where the laser head comprises:

one or more optical transmission media, the one or more optical transmission media being part of an optical path originating at a laser generating unit configured to generate a raw laser beam, the one or more optical transmission media configured for passing the raw laser beam; and an optical assembly coupled to the one or more optical transmission media and configured to shape the raw laser beam for output.

* * * * *